US009215907B2

(12) United States Patent
Linth et al.

(10) Patent No.: US 9,215,907 B2
(45) Date of Patent: Dec. 22, 2015

(54) FOOTWEAR ASSEMBLY WITH OUTSOLE HAVING AN ABRASION RESISTANT ARCH

(75) Inventors: Andrew James Linth, Portland, OR (US); Aaron Barker, Portland, OR (US)

(73) Assignee: LaCrosse Footware, Inc., Portland, OR (US)

( * ) Notice: Subject to any disclaimer, the term of this patent is extended or adjusted under 35 U.S.C. 154(b) by 456 days.

(21) Appl. No.: 13/316,201

(22) Filed: Dec. 9, 2011

(65) Prior Publication Data

US 2012/0144701 A1 Jun. 14, 2012

Related U.S. Application Data

(60) Provisional application No. 61/422,552, filed on Dec. 13, 2010.

(51) Int. Cl.

| | |
|---|---|
| ***A43B 5/00*** | (2006.01) |
| ***A43B 13/04*** | (2006.01) |
| ***A43B 13/16*** | (2006.01) |
| ***A43B 13/22*** | (2006.01) |

(52) U.S. Cl.

CPC ..... *A43B 13/223* (2013.01); *A43B 5/00* (2013.01); *A43B 13/04* (2013.01); *A43B 13/16* (2013.01)

(58) Field of Classification Search

CPC ..... A43B 1/10; A43B 5/00; A43B 5/005; A43B 13/04; A43B 13/16; A43B 13/223

USPC ..... 36/25 R, 31, 103, 107, 113

See application file for complete search history.

(56) References Cited

U.S. PATENT DOCUMENTS

| | | | | |
|---|---|---|---|---|
| 6,006,450 | A * | 12/1999 | Hayes | 36/107 |
| 6,115,946 | A * | 9/2000 | Morris et al. | 36/115 |
| 6,151,806 | A * | 11/2000 | Morris et al. | 36/136 |
| 6,247,251 | B1 * | 6/2001 | James | 36/115 |
| 6,467,198 | B1 * | 10/2002 | James | 36/115 |
| 6,863,284 | B2 * | 3/2005 | Wegener | 280/11.231 |
| 7,165,774 | B2 * | 1/2007 | Adams | 280/11.221 |
| 7,594,666 | B2 * | 9/2009 | Wegener | 280/11.15 |
| 8,296,973 | B2 * | 10/2012 | Roberti | 36/113 |
| 2010/0229424 | A1 * | 9/2010 | Roberti | 36/91 |

* cited by examiner

*Primary Examiner* — Khoa Huynh
*Assistant Examiner* — Sharon M Prange
(74) *Attorney, Agent, or Firm* — Perkins Coie LLP

(57) ABSTRACT

An aspect of the present disclosure includes footwear with a sole assembly including an abrasion resistant medial arch portion. In various embodiments, a sole assembly can include a primary portion extending across lateral, toe, and heel regions of the sole assembly, and a secondary portion at a medial arch region of the sole assembly. The primary portion can include a first compound having a first durometer and the secondary portion can include a second compound having a second durometer higher than the first durometer. Additionally, the sole assembly can include a dam portion spaced between the primary and secondary portions. The dam portion can include sidewalls that form a recess configured to separate the first compound from the second compound.

13 Claims, 3 Drawing Sheets

FOOTWEAR ASSEMBLY WITH OUTSOLE HAVING AN ABRASION RESISTANT ARCH

CROSS-REFERENCE TO RELATED APPLICATION(S)

This application claims the benefit of U.S. Provisional Application No. 61/422,552, filed Dec. 13, 2010, and incorporated herein by reference in its entirety.

TECHNICAL FIELD

The present technology is directed to footwear, and more particularly to footwear with sole assemblies having abrasion resistant portions and methods of making the same.

BACKGROUND

Fast-roping is a method of exiting an aircraft, such as a helicopter, while the aircraft hovers above the ground. This deployment method is often used by military personnel and Special Forces when ground fire, poor conditions, and/or poor terrain prevent helicopters from landing. During a fast-roping deployment, a rope is extended from a helicopter and a person quickly descends the rope using his or her hands and feet as restraints. No harnesses, carabineers, or other extraneous equipment beyond gloves are used while fast-roping. Accordingly, the person can quickly release and move away from the rope once on the ground, so as to avoid interfering with others descending along the same rope. This allows several people to simultaneously descend along the same rope while being spaced apart from each other. Thus, fast-roping is particularly useful for quickly deploying troops in hazardous environments.

Without additional restraints or braking mechanisms, fast-roping can create a large amount of heat and friction on a fast-roper's gloves and shoes and, thus, wear on any material that contacts the rope. It is desirable to provide footwear that can withstand the heat, friction, and abrasive wear typically encountered during fast roping, and substantially without leaving any residue on the rope. Any such residue left on a rope from gloves and shoes can cause the rope to become more slippery over time or otherwise wearing the rope faster than desired. For example, some agencies instruct the fast ropers to not grip the rope with their feet during descent because shoe polish and leather on boots can rub onto the rope, thereby changing the frictional characteristics of the rope over time. However, it is often beneficial for fast-ropers to use their feet to provide additional strength and braking or speed control capabilities during descent. Thus, it would be advantageous to have footwear that can withstand the rigors of fast-roping without leaving residue on the rope, while also being suitable for other uses, such as hiking, running, climbing, etc. after the person has descended the rope.

DETAILED DESCRIPTION

The present disclosure is directed toward footwear with sole assemblies that include abrasion resistant portions at a medial arch region of the sole assembly and associated methods of manufacture. Several specific details of the new technology are set forth in the following description and the Figures to provide a thorough understanding of certain embodiments of the technology. Additionally, many of the dimensions, angles, and other features shown in the Figures are merely illustrative of particular embodiments of the technology. One skilled in the art, however, will understand that the new technology may have additional embodiments, and that other embodiments of the technology may be practiced without several of the specific features described below.

Figure 1:
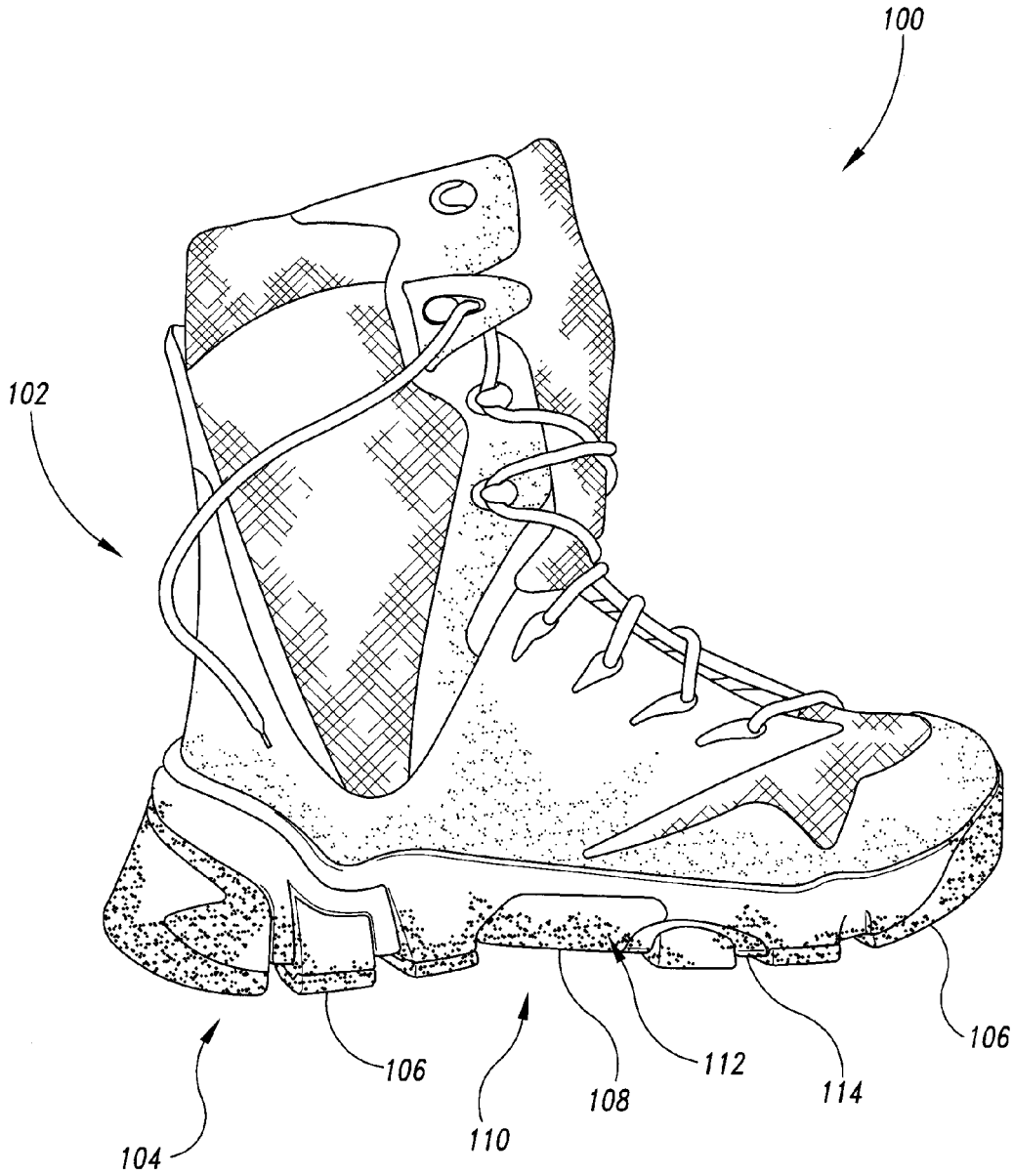
FIG. 1 is a medial side elevational view of a boot having a sole assembly with an abrasion resistant portion in accordance with an embodiment of the new technology.

Embodiments of the new technology are directed to footwear having an upper attached to a sole assembly. FIG. 1 is a medial side view of a boot assembly 100 in accordance with an embodiment of the new technology. Although the following description of the embodiments refers to a boot, the present technology applies to the upper of other types of footwear.

As shown in FIG. 1, the illustrated boot 100 has an upper 102 attached to a sole assembly 104 via stitching, gluing, direct attaching, and/or other suitable fastening methods. The upper 102 can include leather, nylon, cloth, and/or other materials or combination of materials suitable for uppers 102 and associated liners.

The sole assembly 104 of the illustrated embodiment can include a primary portion 106 made of a first material and a different secondary portion 108 made of a second material. The secondary portion 108 can cover a medial arch region 110 of the sole assembly 104, while the primary portion 106 can cover the remainder of the sole assembly 104, including the areas of the sole that engage the ground while walking, running, hiking, climbing, etc. The first material at the primary portion 106 can have a first durometer and the second material at the secondary portion 108 can have a second durometer higher than the first durometer. For example, the first material can be a rubber compound that provides good traction for the primary ground-engaging surface of the sole, while the second material can be made from a highly abrasion resistant rubber compound configured for engagement with a rope during fast roping. The secondary portion 108 can, therefore, provide a substantially abrasion resistant surface that can withstand high levels of friction and heat. A fast-roper, for example, can use the secondary portion 108 for braking when descending a rope without degrading the secondary portion 108 and without leaving residue on the rope or degrading the rope over time.

As shown in the embodiment illustrated in FIG. 1, the secondary portion 108 can extend upward along a medial side of the upper 102. The extended secondary portion 108 can provide a large area around the arch portion for contacting the rope and reduce the likelihood that other portions of the boot assembly 100 (e.g., the upper 102) will contact the rope during a fast-roping descent. Accordingly, the secondary portion 108 is configured the engage the rope and to isolate the upper or other portions of the boot from engaging the rope during fast-roping. This construction can allow leather, nylon, or other materials to be used for the upper that otherwise would not be suitable for use in a fast-roping boot. Additionally, the secondary portion 108 can be shaped to form a contact region 112 between a bottom surface 114 of the sole assembly 104 and the upper 102. The contact region 112 can include a relatively sharp edge (e.g., 90°) between a bottom surface and a sidewall surface that can engage the rope to help provide the fast-roper with better control of the descent. In other embodiments, the contact region 112 can include a relatively smooth recess or other contoured area shaped and sized to receive the rope and provide a greater surface area for engagement with the rope to facilitate descent down the rope. In another embodiment, the contact region 112 can include a rounded transition area between the bottom surface and the sidewall surface of the sole assembly, such that the rounded transition area can glide over the rope, and/or another suitable configuration that can aid vertical insertion of the rope during descent.

Figure 2:
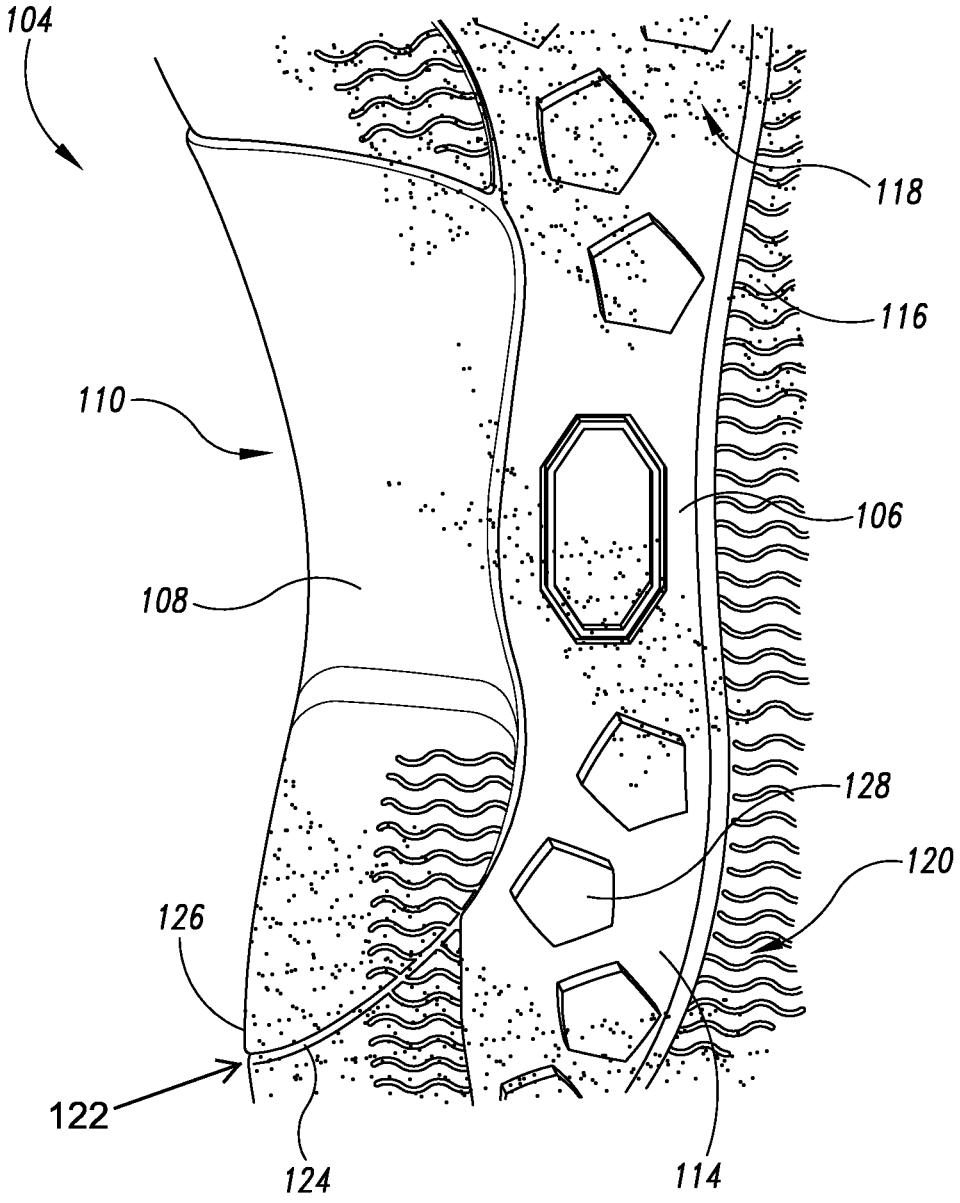
FIG. 2 is an enlarged partial bottom plan view of a sole assembly having an abrasion resistant portion in accordance with an embodiment of the new technology.

FIG. 2 is a partial bottom plan view of the sole assembly 104 shown in FIG. 1 and configured in accordance with an embodiment of the new technology. The primary portion 106 of the sole assembly 104 can extend across the majority of the shoe. As shown in FIG. 2, for example, the primary portion 106 can extend over a lateral region 116, a forefoot region 118, and/or a heel region 120. The secondary portion 108 can extend across the medial arch region 110. In some embodiments, the primary portion 106 can make up approximately 90% of the sole assembly 104 and the secondary portion 108 can make up approximately 10%. In other embodiments, the secondary portion 108 can extend beyond the medial arch region 110, across a greater portion of the sole assembly 104 to provide a larger surface area for contacting the rope. For example, in the embodiment illustrated in FIG. 2, the secondary portion 108 extends rearwardly from the medial arch region 110 and into part of the heel region 120. In this embodiment, the heel region has an elevated heel, a portion of which forms the rear part of the secondary portion. This part of the elevated heel in the secondary portion 108 provides a structure extending from the medial arch region 110 (e.g., approximately perpendicular to the medial arch region) that the wearer can use to engage the rope during fast roping. In other embodiments, the secondary portion 108 can extend partially into the forefoot portion just forward of the medial arch region 110.

As discussed above, the primary and secondary portions 106 and 108 are made from materials having different durometers. The primary portion 106 can be made from one or more materials that provide beneficial traction properties. For example, the primary portion 106 can be a synthetic rubber compound and/or another material that provides adequate traction and support. In some embodiments, the primary portion 106 include a plurality of materials located a different parts of the sole assembly 104. For example, the primary portion 106 can include one material at the lateral region 116 and a different material at the forefoot and heel regions 118 and 120.

The secondary portion 108 is made from a material that has a higher durometer than the material at the primary portion 106, such that the secondary portion 108 can withstand friction and facilitate the use of the person's feet while fast-roping. Suitable materials for the secondary portion 108 can have a Shore A value between approximately 55 and 75, inclusive, but the secondary portion 108 can also include materials having a Shore A value above 90. For example, the secondary portion 108 can be made from a rubber compound with a low carbon component, synthetic neoprene, a V-4 compound, and/or other suitable materials with sufficient hardness and abrasion resistance for fast-roping. Additionally, the materials used for the secondary portion 108 can also withstand high temperatures such that the secondary portion 108 will not substantively degrade when friction increases the temperature of the material during descent. The material of the secondary portion 108 is also configured so that it will not excessively wear, fray, cut, or otherwise degrade the rope during fast-roping.

In embodiments of the present technology, the sole assembly 104 can be an outsole made up of the primary and secondary portions 106 and 108 discussed above. In other embodiments, the sole assembly 104 can have a multipart construction with an outsole, a midsole and/or an insole, wherein the outsole comprises the primary and secondary portions 106 and 108. The outsole is coupled to a conventional midsole and/or insole. In other embodiments, primary and/or secondary portions can be formed by one or more portions of the outsole and the midsole.

In the illustrated embodiment, the sole assembly 104 is formed by co-molding the primary portion 106 and the secondary portion 108. For example, both the first and second materials can be placed in a selected mold that can then be closed, and heat and pressure can be applied to the materials in the mold, causing the two materials to co-mold and form the sole assembly 104 described above. In some embodiments, the sole assembly 104 can be vulcanized after molding to make the sole assembly 104 more durable. In other embodiments, the materials of the primary and secondary portions 106 and 108 can be injection molded, bonded, and/or otherwise joined together using other suitable methods for forming sole assemblies.

In the embodiment illustrated in FIG. 2, the sole assembly 104 further includes a dam 122 separating the primary and secondary portions 106 and 108 of the sole assembly 104. The dam 122 can have sidewalls 124 that form a recess 126 separating the different materials in the primary and secondary portions 106 and 108. The dam 122 can help prevent the materials from mixing together along the exterior surface of the sole assembly 104 during manufacture. For example, the dam 122 can prevent compound migration when the primary portion 106 is co-molded with the secondary portion 108.

As shown in FIG. 2, the sole assembly 104 can also include a plurality of lugs 128 spaced apart from one another across the primary portion 106 to increase traction during use of the boot before or after fast-roping. In the illustrated embodiment, the lugs 128 are pentagonal-shaped protrusions extending from the bottom surface 114 of the sole assembly 104. In other embodiments, the lugs 128 can have a different shape and/or extend from other surfaces of the sole assembly 104. The lugs 128 can be integrally formed with the primary portion 106 during molding of the sole assembly 104 and can be made from the same material as the primary portion 106. In other embodiments, the lugs 128 can be joined with the primary portion 106 after molding and/or made from different materials than the primary portion 106 (e.g., metal). In further embodiments, the sole assembly 104 can include other traction elements (e.g., studs, grooves) that can increase traction of the sole assembly 104.

The sole assembly 104 can provide the boot assembly 100 shown in FIG. 1 and other footwear assemblies with an all-purpose sole that can be used in the field (e.g., during combat, work, etc.) and while performing specialized activities that require abrasion resistant sole portions, such as fast-roping. The material and shape of the primary portion 106 can provide good traction for general use, and the high durometer material at the secondary portion 108 can provide a highly abrasion-resistant surface for contacting a rope during fast-roping. Additionally, the dam 122 can maintain the integrity of the materials at the interface between the primary and secondary portions 106 and 108, such as when the primary and secondary portions are co-molded.

Figure 3:
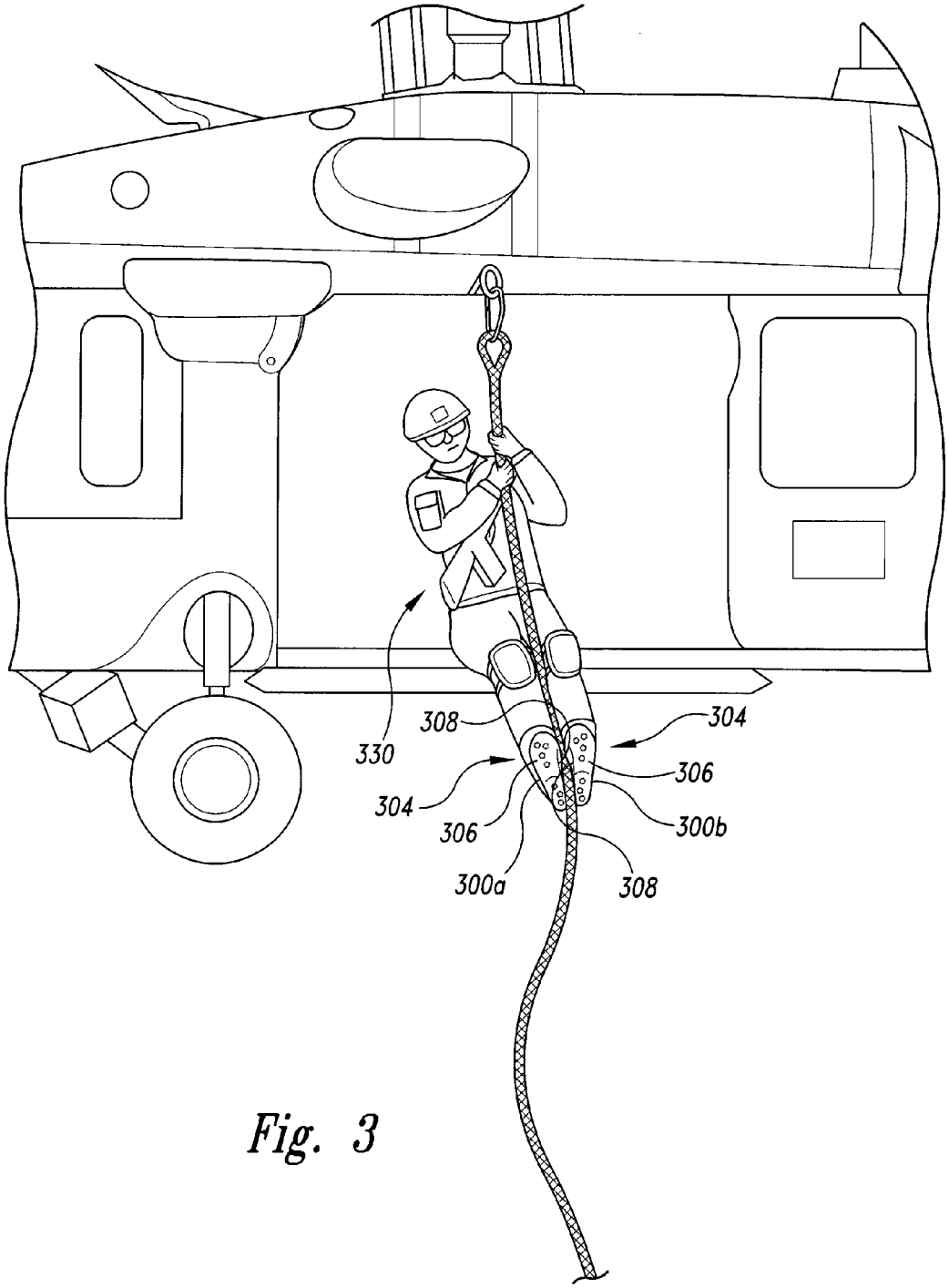
FIG. 3 is an isometric view of a fast-roper wearing a boot having a sole assembly with an abrasion resistant portion in accordance with an embodiment of the disclosure.

FIG. 3 is an isometric view of a fast-roper 330 using a pair of boots 300 (identified individually as a first boot 300*a* and a second boot 300*b*) in accordance with an embodiment of the disclosure. The boots 300 can include generally similar features as the boot assembly 100 described in FIGS. 1 and 2. For example, the boots 300 can include a sole assembly 304 having a primary portion 306 and a secondary portion 308 at a medial arch region 310 of the sole assembly 304. The secondary portion 308 can be made from a high durometer material that does not degrade during fast-roping. As shown in FIG. 3, the fast-roper 330 can grip a rope 332 with his gloves and the boots 300 to suspend himself from a helicopter and above ground. The secondary portions 308 of each sole assembly 304 can contact the rope 332 as the fast-roper 330 descends to the ground. The abrasion-resistant secondary portion 308 can withstand the high friction and temperature of descent without leaving residue on the rope 332. Thus, the sole assembly 304 allows the fast-roper to use the boots to engage the rope and help control descent speed along the rope, substantially without degrading the boots or the rope over time.

From the foregoing, it will be appreciated that specific embodiments of the invention have been described herein for purposes of illustration, but that various modifications may be made without deviating from the invention. Additionally, aspects of the invention described in the context of particular embodiments or examples may be combined or eliminated in other embodiments. Although advantages associated with certain embodiments of the invention have been described in the context of those embodiments, other embodiments may also exhibit such advantages. Additionally, not all embodiments need necessarily exhibit such advantages to fall within the scope of the invention. Accordingly, the invention is not limited except as by the appended examples.

The invention claimed is:

1. A footwear assembly configured for use when fast roping on a rope, comprising:

an upper; and a sole assembly configured for use when fast roping on a rope, the sole assembly having an upper surface attached to the upper, a bottom surface opposite the upper surface, and a sidewall surface between the upper and bottom surfaces, the sole assembly comprising:

a primary portion extending across a lateral region of the sole assembly, the primary portion comprising a first rubber compound having a first durometer;

a secondary portion at a medial arch region of the sole assembly, the secondary portion being molded with the primary portion and comprising a second rubber compound having a second durometer greater than the first durometer and being abrasion resistant, wherein the secondary portion is configured to engage the rope during fast roping without leaving rubber compound residue on the rope, the secondary portion having a smooth, concave rope engaging surface configured to directly engage the rope and provide braking and speed control during fast roping, and wherein a lateral edge of the secondary portion is spaced from a lateral edge of the bottom surface of the sole assembly, the secondary portion forms the rope engaging surface between the bottom surface and the upper surface, wherein the rope engaging surface includes a generally sharp edge between the bottom surface and the sidewall surface; and a dam portion spaced between the primary and secondary portions, the dam portion having sidewalls, wherein the sidewalls form a recess that separates the first compound from the second compound wherein the dam portion prevents compound migration between the first and second rubber compounds when the primary portion is molded with the secondary portion.

2. The footwear assembly of claim 1 wherein the second rubber compound comprises a low-carbon compound.

3. The sole assembly of claim 1, wherein the primary portion and secondary portion are co-molded.

4. The sole assembly of claim 1 wherein the second rubber compound has a Shore A value from about 55 to about 75.

5. The sole assembly of claim 1 wherein the second rubber compound has a Shore A value of approximately 90 or greater.

6. A sole assembly for an article of footwear configured for use when fast roping on a rope, comprising:

opposing upper and bottom surfaces, and a sidewall surface extending between the upper and bottom surfaces;

a primary portion extending across lateral, toe, and heel regions of the sole assembly, the primary portion comprising a first compound having a first durometer;

a secondary portion at a medial arch region of the sole assembly, the secondary portion comprising a second compound having a second durometer greater than the first durometer and being abrasion resistant, wherein the secondary portion is configured to engage the rope during fast roping without leaving rubber compound residue on the rope, wherein the primary portion and the secondary portion are co-molded, the secondary portion having a smooth, concave rope engaging surface configured to directly engage the rope and provide braking and speed control during and speed control during fast roping, wherein the rope engaging surface includes a generally sharp edge between the bottom surface and the sidewall surface; and a dam portion spaced between the primary and secondary portions, the dam portion defining a recess configured to separate the first compound from the second compound and prevents compound migration between the first and second rubber compounds when the primary portion is molded with the secondary portion.

7. The sole assembly of claim 6 wherein the first compound is a synthetic rubber and the second compound is a highly abrasion-resistant rubber.

8. The sole assembly of claim 6 wherein the second compound has a Shore A value from about 55 to about 75.

9. The sole assembly of claim 6 wherein the second compound has a Shore A value of approximately 90 or greater.

10. The sole assembly of claim 6 wherein the second compound comprises a synthetic neoprene.

11. The sole assembly of claim 6 wherein the second compound comprises a highly heat-resistant rubber.

12. The sole assembly of claim 6 wherein the primary portion comprises approximately 90% of the sole assembly and the secondary portion comprises approximately 10% of sole assembly.

13. The sole assembly of claim 6, further comprising a plurality of lugs coupled to the primary portion and configured to provide traction against contacted surfaces, wherein the individual lugs are spaced apart from one another across the primary portion.

* * * * *